United States Patent [19]

Protta

[11] 3,972,301

[45] Aug. 3, 1976

[54] APPARATUS FOR STEERING A SHIP

[75] Inventor: Jean-Claude Protta, Petit-Lancy, Geneva, Switzerland

[73] Assignee: Oxy Metal Industries Corporation, Detroit, Mich.

[22] Filed: Feb. 21, 1975

[21] Appl. No.: 551,800

[30] Foreign Application Priority Data

June 12, 1974 Switzerland ..... 8017/74

[52] U.S. Cl. ..... 114/162; 114/144 R; 114/144 C; 244/87

[51] Int. Cl.[2] ..... B63H 25/06

[58] Field of Search ..... 114/144 R, 144 E, 144 A, 114/144 C, 162, 167, 146; 318/588, 589; 244/77 F, 87, 42 DA

[56] References Cited

UNITED STATES PATENTS

| | | | |
|---|---|---|---|
| 1,681,415 | 8/1928 | Lee | 114/144 C |
| 1,777,912 | 10/1930 | Corcoran | 114/162 |
| 2,120,717 | 6/1938 | Sikorsky | 244/87 |
| 2,315,110 | 3/1943 | Dornier | 244/87 |
| 3,140,436 | 7/1964 | Hatch | 114/144 E |
| 3,685,478 | 8/1972 | Casani et al. | 114/144 E |

FOREIGN PATENTS OR APPLICATIONS

| | | | |
|---|---|---|---|
| 1,039,869 | 9/1958 | Germany | 114/162 |

*Primary Examiner*—Trygve M. Blix
*Assistant Examiner*—Charles E. Frankfort
*Attorney, Agent, or Firm*—Richard P. Mueller; Arthur E. Kluegel; B. F. Claeboe

[57] ABSTRACT

An apparatus for automatically maintaining a ship on a pre-selected course in which a trim tab is secured to a rudder. The trim tab contains a motor therein which is responsive to an electric signal such that the motor will actuate the trim tab when a signal is applied thereto such as when the ship deviates from its pre-selected course. The trim tab can be released from the rudder so that it can be manually operated if so desired.

4 Claims, 5 Drawing Figures

APPARATUS FOR STEERING A SHIP

DESCRIPTION OF THE PRIOR ART

It is a generally known concept to utilize a trim tab to effectuate movement of a rudder to steer a ship. The devices used to effectuate a deflection or movement of a trim tab have been in the form of rods or cables which were directly connected to the steering wheel. Manual movement of the steering wheel thus caused a corresponding movement of the trim tab which then forced the rudder into its desired deflection angle with respect to the ship.

The art also developed the use of an electric motor which was substituted for the manual operation of the steering wheel. The electric motor was interconnected with a bowden cable which actuated the trim tab.

The mechanisms for steering a ship which were developed in the prior art utilized rods, levers, and cables which were cumbersome, expensive, fragile, and were unreliable because of their susceptibility to getting out of control. They generally were located within the hull of the ship and were difficult to repair or replace because of their location.

BACKGROUND OF THE INVENTION

In order to overcome the deficiencies of the prior art, it was necessary to develop a reliable trim tab control which could be used in a fluid environment and would dispense with rods, levers and cables as an actuating mechanism.

This invention overcomes the disadvantages of the prior art by providing a trim tab actuator which is housed within the trim tab and is directly connected to the rudder. Thus, the necessity of incorporating rods, levers, or cables through or on the hull of the ship to mechanically actuate the trim tab has been effectively obviated. The trim tab is actuated by means of an electrical signal which can be generated automatically or manually. A desired orientation or course of ship's travel can be set and this course will be automatically maintained. The actuator can also be housed within the rudder, if desired.

DESCRIPTION OF THE PREFERRED EMBODIMENT

Figure 1:
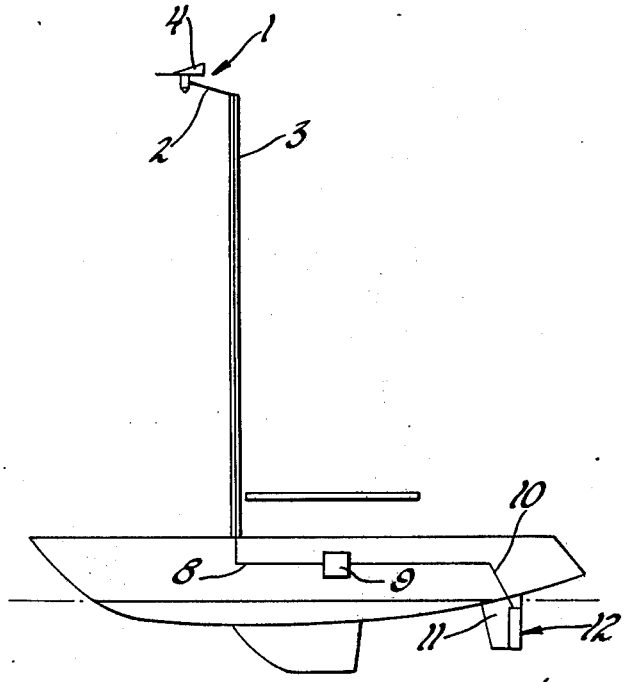
FIG. 1 shows a schematic representation of a sailboat incorporating the invention.
Figure 3:
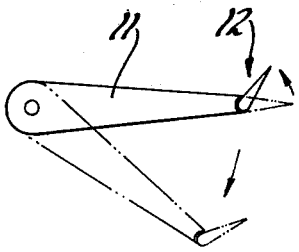
FIG. 3 shows a trim tab secured to a rudder in operative and inoperative positions.
Figure 4:
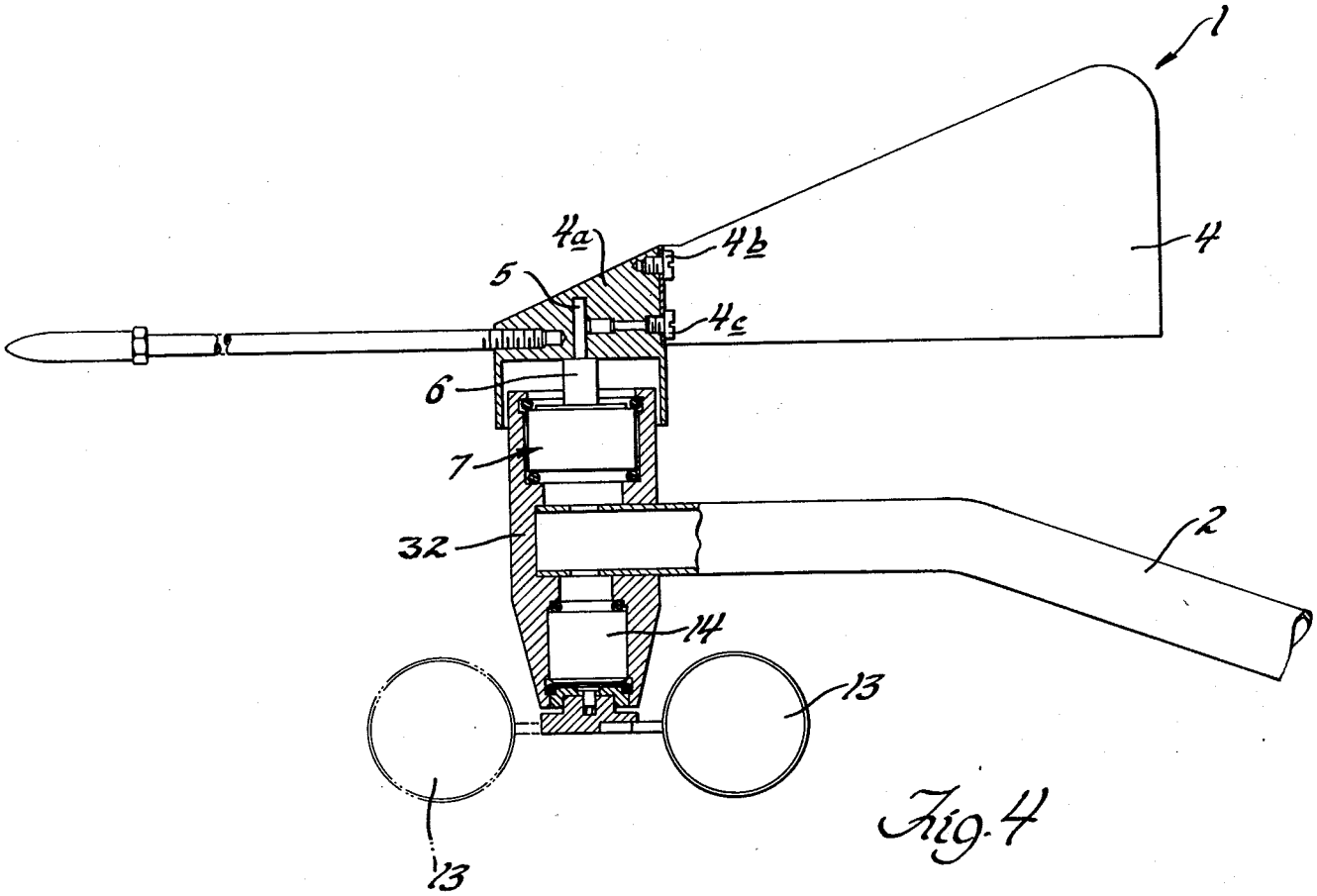
FIG. 4 is a detail shown in plan view, partially in section, of a portion of the invention.
Figure 5:
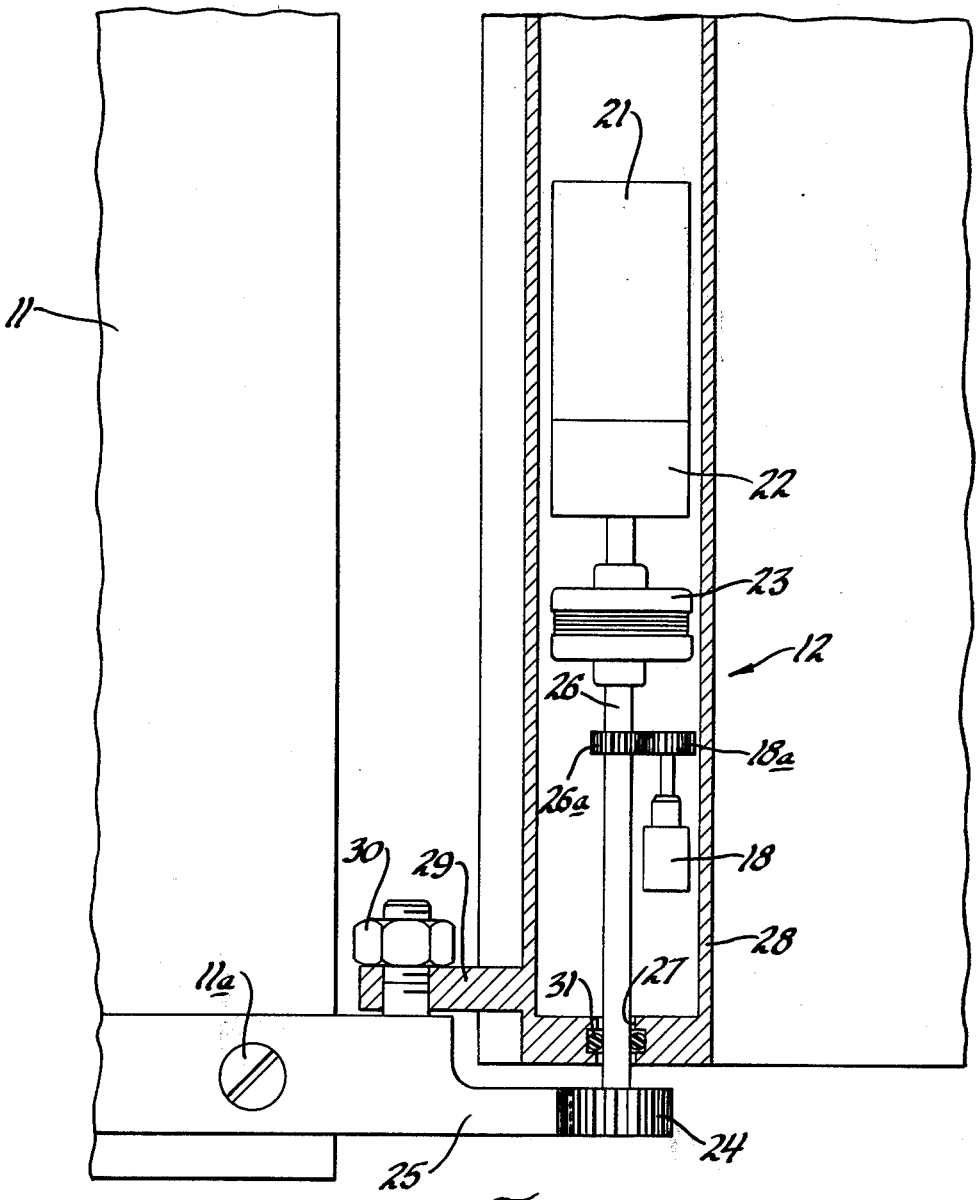
FIG. 5 is a detail in plan view, partially in section, of another aspect of the invention.

Referring to FIG. 1, there is shown a wind vane assembly 1 which is secured to the mast 3 of a ship, such as a sailboat, by a said arm 2. The wing 4 (see FIG. 4) of the vane 1 is generally flattened in configuration so as to present a planar surface to the wind enabling it to be actuated thereby.

The wing 4 is secured to a block 4*a* by any known connecting means such as screws 4*b*. The block 4*a* is secured to a shaft 5, by means of a set screw 4*c*. The shaft 5 is part of the sliding arm 6 of a known linear potentiometer 7. A housing 32 encases the potentiometer 7 and is journalled for rotation about the arm 2.

A known vane wheel 13 can be secured to the shaft of a dynamo 14. The vane wheel which is driven by the wind can be used to induce an output voltage from the dynamo 14 and thereby measure wind speed. This information can be electrically fed to nautical instruments on the ship in a known manner.

The potentiometer 7 is electrically connected via a current-carrying wire 8 to an electrical signal generator 9. The electrical signal generator sends a signal through the current-carrying conductor 10 in the hull of the ship to the rudder 11 and trim tab 12 immersed in the water under the hull.

Figure 2:
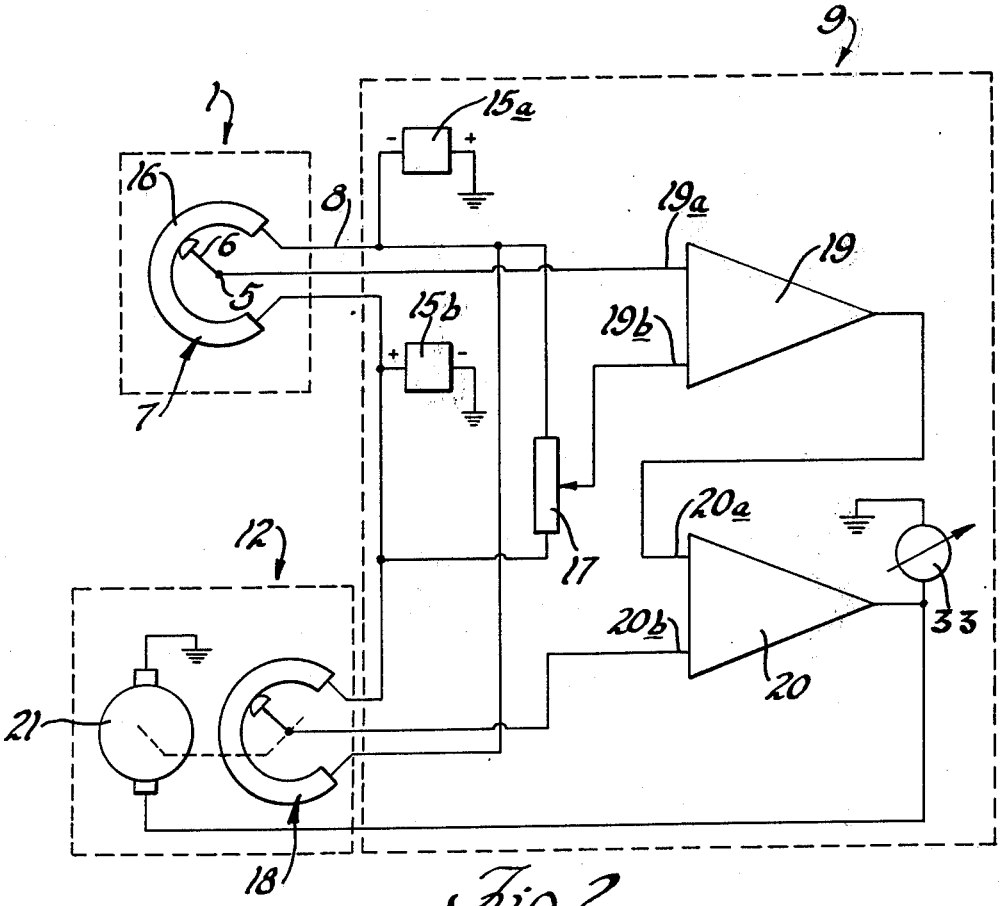
FIG. 2 is a wiring diagram showing the circuitry comprising the invention.

The generator 9 comprises a voltage source divided into two essentially equal parts 15*a* and 15*b*. The voltage sources are connected in series via the conductor 8 as shown in FIGS. 1 and 2. The voltages are connected on either side of the resistive element 16 of the potentiometer 7 located in the vane assembly 1. The generator 9 further comprises a second control potentiometer 17 connected across the potentiometer 7. The potentiometer 17 can be calibrated with indicia showing degrees of angularity (not shown).

A third potentiometer 18 is secured within the trim tab assembly 12 and is electrically connected in parallel to the potentiometer 7.

The signal generator 9 also comprises a first differential amplifier 19, which can be any known signal amplifying means, the inputs 19*a* and 19*b* of which are connected to the slide arms (not shown) of the potentiometers 7 and 17, respectively. A second differential amplifier 20 which can be identical to the first amplifier 19 has a first input lead 20*a* connected to the sliding arm (not shown) of the potentiometer 18, and a second input lead 20*a* is connected to the output of the amplifier 19.

Secured within the trim tab assembly 12 and sealed in a known water-tight manner are a motor 21, a reduction gear assembly 22, a clutch 23 and the potentiometer 18. The motor 21 can be a simple reversing d.c. motor which is controlled by the potentiometer 18 so as to match the angular deflection of the trim tab 12 with a known angular displacement calibrated reading of the sliding arm of the potentiometer 18. The motor 21 has a shaft (not shown) which drives a reduction gear assembly 22. The gearing reduction can be any desired ratio so as to obtain maximum torque. When the clutch 23, which can be any known clutch, for example, one having friction faces, is engaged, the shaft 26 is rotated and a pinion gear 24 secured to the shaft engages a geared segment 25 which is secured to the rudder 11 by means of a screw 11*a* or it can be integral therewith. The shaft 26 extends through a bore 27 in the trim tab housing 28. An O-ring 28 seals the end of the trim tab housing. An arm 29 extends laterally from the trim tab housing 28 and is rotatably secured as by a screw 30 to the segment 25. The motor 21 is also coupled with the potentiometer 18 so as to match the angular deflection of the trim tab 12 with a known calibrated angular displacement of the sliding arm of the potentiometer 18.

In actual operation, the desired angle with respect to the direction of the wind that one desires to set his course is fixed by choosing the angle on the calibrated dial (not shown) on the potentiometer 17. This initial step unbalances the inputs 19*a* and 19*b* of the amplifier 19 which results in the formation of a signal voltage at the output of the amplifier 19. This signal is then applied via the input lead 20*a* of the amplifier 20 which causes the latter to generate a signal for driving the motor 21. The shaft 26 will be turned and the pinion 24 will engage the gear segment 25 fixed to the rudder and rotate the rudder to the desired angularity thereby setting the ship's course. The movement of the shaft 26 will also effect movement of the engaging member 26*a* which can be a gear, which actuates the engaging member 18*a* on the potentiometer which can also be a gear member. The input levels 20*a* and 20*b* of the differential amplifier will then be essentially the same, and this will cancel the output voltage at the amplifier 20.

The movement of the trim tab 12 makes the trim tab act like a rudder and a movement of the rudder 11 will ensue which will modify the direction of the ship, and hence, provide a corresponding variation of the position of the vane (and jointly of the finger 6 of the potentiometer 7) relative to that of the ship. This movement will tend to equilibrate inputs 19*a* and 19*b* and cancel the output of the amplifier 19. When the latter condition occurs, the inputs 20*a* and 20*b* are again out of balance (but in the opposite direction as compared to previously) and the consecutive signal at the output of the amplifier 20 will drive the motor 21 so as to return the trim tab 12 to its neutral position, that is to maintain the ship along its new direction.

In practice, the user may desire to initially set his course manually (by means of the steering wheel) which will set the rudder 11 to the desired angle, and then adjust the knob of the control potentiometer 17 until the output signal of the amplifier 20 is at a zero reading, which could also be displayed by an indicator, for example, a calibrated voltmeter 33. Since a zero output has been logged into the differential amplifier 20, no output signal will be received by the motor 21 and the trim tab 12 will be in its neutral position; i.e., in alignment with the rudder 11.

The clutch 23 has the advantage of enabling the user to uncouple the motion of the trim tab 12 from the motor 21. This will permit the user the flexibility of manually steering the ship if so desired.

It will be noted that the C-shape configuration of the resistive portion of the potentiometers 7 and 18 will preclude movement of the sliding arm over a complete 360°. Since the median portion of the resistors of said potentiometers corresponds to the down-wind position, it is seen that the dead angle of said controls corresponds to about 5° to 10° on both sides of the up-wind position, a position which is of no significance under normal use of a ship such as a sailing boat.

The disclosed automatic steering system could also be controlled by an ordinary electronic compass which supplies signals comparable to those available from the sliding arm 6 of the potentiometer 7, in which case, the direction followed would be that of a geographic beacon rather than a given angle with the wind.

The disclosed invention could be operated by hand when the potentiometer is a manual control instead of a vane-driven device.

I claim:

1. An apparatus for steering a ship comprising, a. a trim tab adapted to be rotatably secured to a rudder for movement relative thereto, b. drive means secured to and sealed within said trim tab in a water-tight manner, wherein said drive means is responsive to an electrical signal for rotating said trim tab relative to said rudder, and c. generator means on said ship for transmitting said electrical signal to the drive means.

2. An apparatus for steering a ship as defined in claim 1 in which the generator means comprises amplifier means which transmit a signal directly to said drive means.

3. An apparatus for steering a ship as defined in claim 2 in which the generator means is connected to a piloting means for setting a predetermined course.

4. An apparatus for steering a ship as defined in claim 3 wherein the amplifier means of the generator means comprises two differential amplifiers and the amplifier means has its output connected to the drive means, an input to one amplifier is connected to said piloting means and an input of the second amplifier is connected to an element of said drive means which provides a signal being a function of the angle between the rudder and the trim tab, such that by actuation of the drive means any difference between the two inputs of said differential amplifiers is cancelled.

* * * * *